United States Patent [19]

Sando et al.

[11] 4,437,200

[45] Mar. 20, 1984

[54] APPARATUS FOR CONTINUOUS DEHYDRATION

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 347,958

[22] Filed: Feb. 11, 1982

[30] Foreign Application Priority Data

Feb. 25, 1981 [JP] Japan ..... 56-26610

[51] Int. Cl.[3] ..... F26B 13/04

[52] U.S. Cl. ..... 15/306 A; 15/316 R; 34/70; 68/5 E; 68/19.1; 100/173

[58] Field of Search ..... 68/5 D, 5 E, 19.1, 20, 68/22 R, 22 B, 99, 244, 264; 100/173–176; 34/70, 242; 15/306 A, 316 R; 226/113, 196

[56] References Cited

U.S. PATENT DOCUMENTS 3,195,163 7/1965 Townley et al. ..... 15/306 A 3,421,164 1/1969 Zuczek ..... 68/22 R X 3,546,902 12/1970 Sando et al. ..... 68/5 E

FOREIGN PATENT DOCUMENTS 491740 2/1976 U.S.S.R. ..... 68/5 E

*Primary Examiner*—Philip R. Coe

*Attorney, Agent, or Firm*—Toren, McGeady and Stanger

[57] ABSTRACT

An apparatus for continuous dehydration of a cloth comprising two pairs of rubber rolls with the rolls of each pair pressed against one another, a cylindrical seal plate which is positioned between the two pairs of the rubber rolls in pressure contact with each of the rubber rolls and provided with a pair of axially extending slits opening in the direction toward each of the contact surfaces of the pairs of the rubber rolls, and an end plane seal plate blocking the both end openings of the seal plate and contact with the end plane of each of the rubber rolls so as to form a closed chamber intercepting the interior of the cylindrical seal plate from the exterior thereof.

3 Claims, 5 Drawing Figures

FIG.5
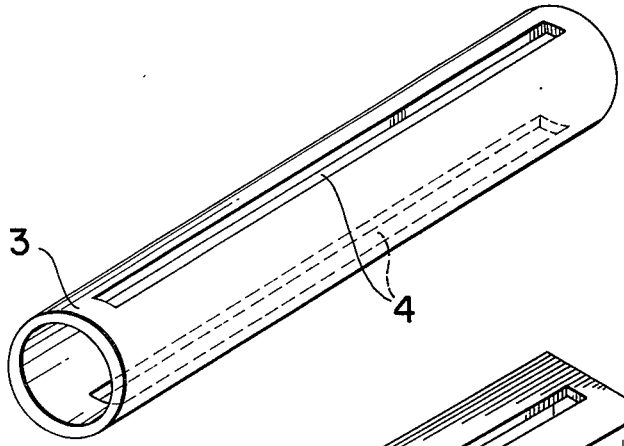
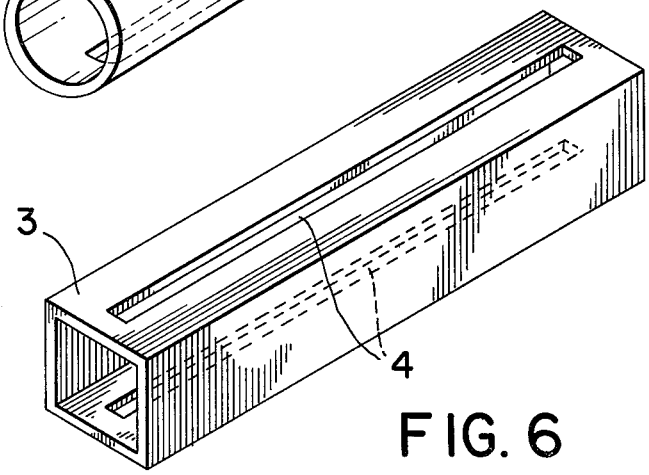
FIG. 6

APPARATUS FOR CONTINUOUS DEHYDRATION

BACKGROUND OF THE INVENTION

The present invention relates to an apparatus for continuous dehydration of a cloth with the use of a closed chamber under increased or reduced pressure comprising a space formed with four rolls as its main constituents.

As an example of the apparatus for continuously dehydrating a cloth soaked with a treating solution and running continuously, a squeeze mangle comprising a pair of pressure rolls pressed with each other has been well known. However, since such a liquid squeeze means comprising merely the combination of pressure rolls has a limit in its pressing force to be applied for the cloth, a sufficient liquid squeezing cannot be done frequently. For instance, a squeeze mangle comprising the combination of two pressure rolls can only squeeze the cloth up to about 50%, so that a sufficient dehydration cannot be expected. To elevate the squeeze effect, it has also been proposed to combine four rolls (a) pressed with one another as shown in FIG. 1, in which the space (b) surrounded with the four rolls is made into a reduced pressure chamber to squeeze the cloth due to the effect of the contact pressure of the rolls and the reduced pressure in the space (b). However, in such a squeeze apparatus, a cloth to be transported continuously must be bent along a roll (a), not going straight, so that there occurs a problem that creases are caused to occur to the cloth in guiding the cloth in a bending way. To avoid the occurrence of creases by transporting the cloth straight, it has also been proposed, as shown in FIG. 2, to provide intermediate rolls (d), (d) respectively between the squeeze rolls (a), (a) and (a'), (a') and to make the space (b') surrounded with the squeeze rolls and the intermediate rolls as a reduced pressure chamber for squeezing the cloth passing through this reduced pressure chamber. In this apparatus, however, particularly when the lengths of the rolls (a), (a') and (d) are long in accordance with the width of the cloth, the rolls, particularly the intermediate rolls (d) are bent unavoidably to the direction of the reduced pressure chamber due to the effect of negative pressure, so that there occurs gaps between the squeeze rolls and the intermediate rolls to cause such a trouble that the interior of the reduced pressure chamber cannot be maintained in a state of negative pressure effectively.

SUMMARY OF THE INVENTION

To dissolve such drawbacks as mentioned above, the object of the present invention is to offer an apparatus for continuous dehydration of a cloth, with which continuous dehydration of a cloth can be done effectively, by the combination of four seal rolls and a cylindrical seal plate. The essential points of the invention comprise two pairs of rubber rolls, four rolls in total, respectively pressed with each other, a cylindrical seal plate which is positioned between the two pairs of rubber rolls in pressure contact with each of the rubber rolls and provided with a pair of slits opening in the direction to each of the contact surface of the pairs of the rubber rolls, and an end plane seal plate blocking the both end openings of the said seal plate and contacting with the end plane of each of the rubber rolls so as to form a closed chamber under increased or reduced pressure intercepting the interior of the cylindrical seal plate from the exterior thereof. The cylindrical seal plate may be substituted with a square type one.

BRIEF DESCRIPTION OF THE DRAWINGS

FIG. 5 is an oblique figure of the cylindrical seal plate in the apparatus, and FIG. 6 is an oblique figure displaying another embodiment of the seal plate in the apparatus.

DETAILED DESCRIPTION OF THE PREFERRED EMBODIMENTS

Figure 1:
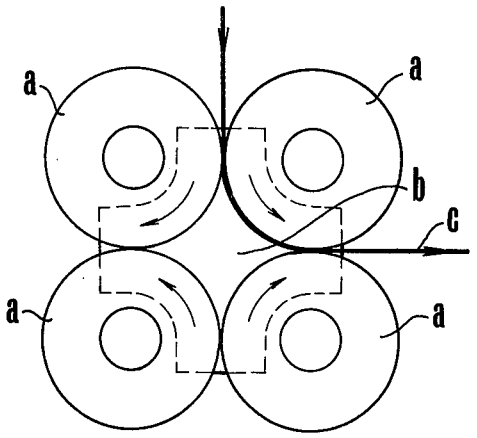
FIG.1 PRIOR ART
FIGS. 1 and 2 are explanatory drawings showing the examples of the conventional apparatuses for continuous dehydration of a cloth.
Figure 2:
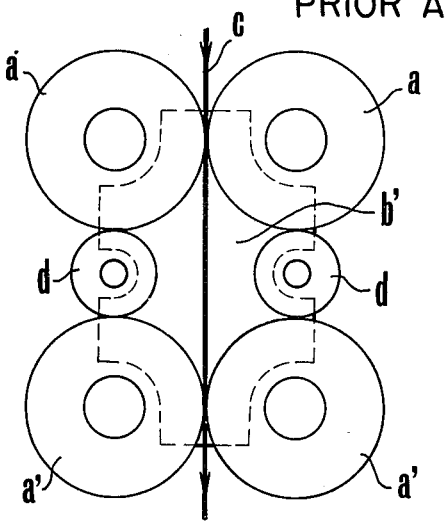
FIG.2 PRIOR ART
Figure 3:
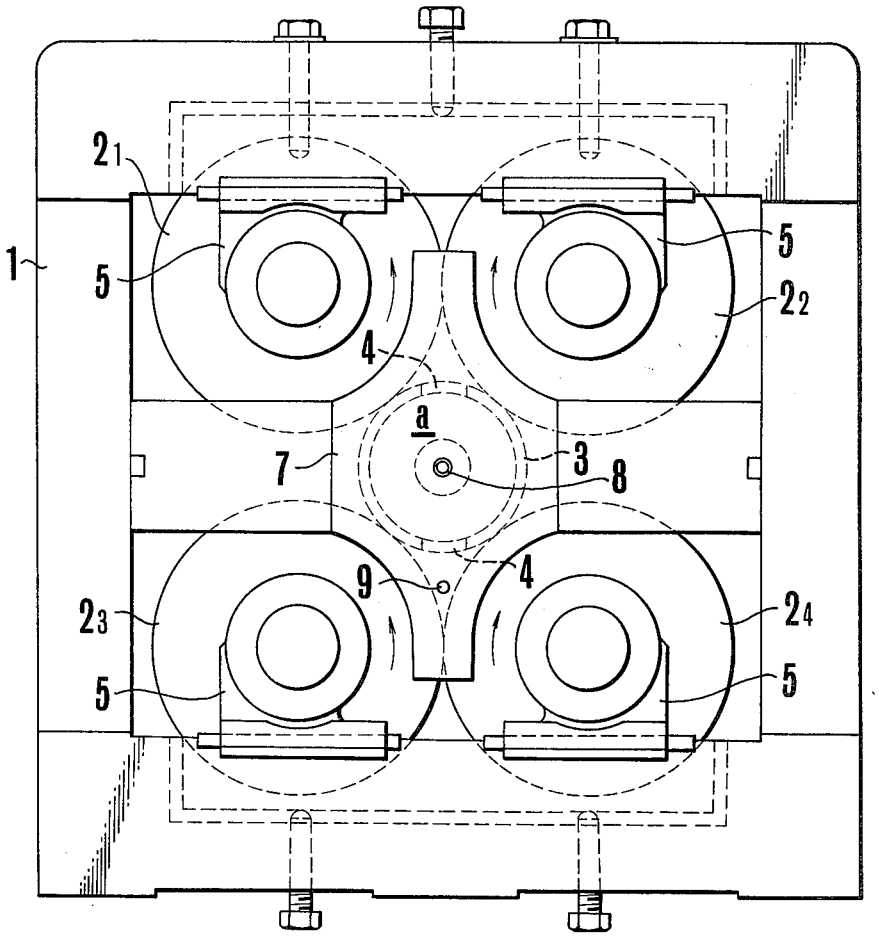
FIG. 3 is a side view of an example of the present inventive apparatus for continuous dehydration of a cloth.
Figure 4:
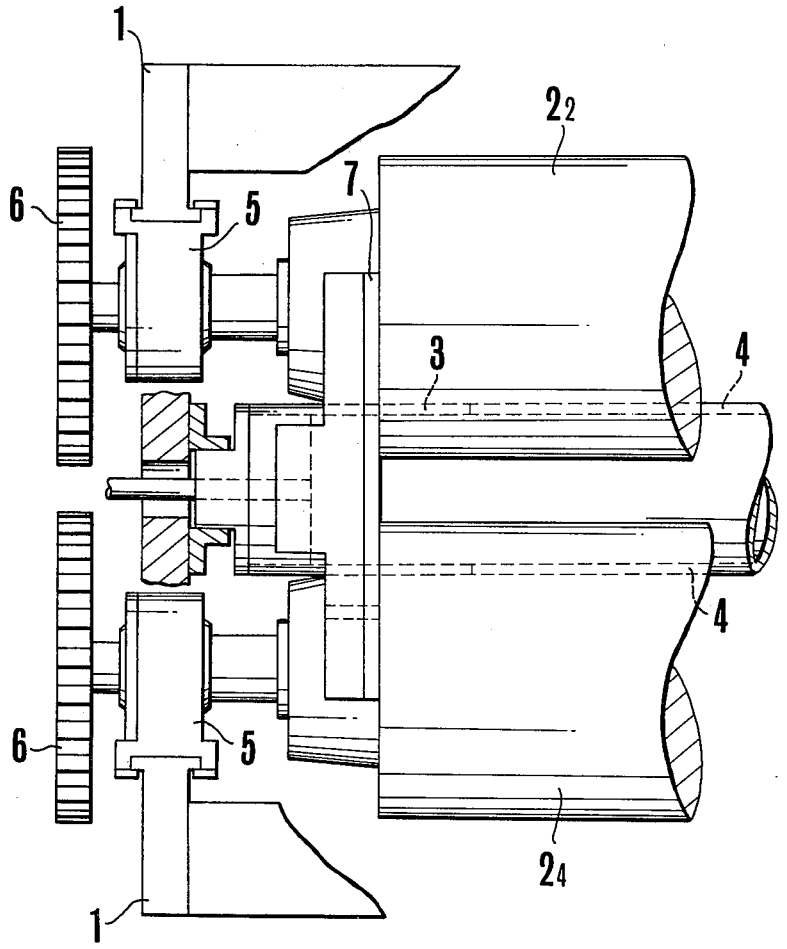
FIG. 4 is a front view of the main part thereof.

Preferred embodiments of the present invention will be described in detail in the following according to FIGS. 3, 4 and 5.

1 is a base frame of the apparatus, to which four rubber rolls $2_1$, $2_2$, $2_3$ and $2_4$ are attached freely rotatable. In this example, a pair of rubber rolls $2_1$ and $2_2$ and another pair of $2_3$ and $2_4$ are combined respectively so that the rolls in each pair are in pressure contact with each other, and the rubber rolls $2_1$ and $2_3$ as well as the rubber rolls $2_2$ and $2_4$ are provided spaced apart. 3 is a tubular or cylindrical seal plate made of a metal provided in the space surrounded by the four rubber rolls and in contact with all the four rubber rolls $2_1$, $2_2$, $2_3$ and $2_4$. This seal plate 3 has, as seen from FIG. 5, a pair of oppositely disposed slits 4 opening to the interior of the seal plate and extending in the axial direction of the cylinder seal plate except for the end parts thereof for transferring a cloth to be treated therethrough. 5 are bearings attached to the base frame 1 for supporting the rubber rolls, their position being freely adjustable. 6 are driving gears fixed to the rubber rolls, and each of the rubber rolls can be rotated with an equal speed in the direction as shown with arrows in the figure by means of the driving gears. 7 are end plane seal plates provided in contact with both ends of each of the rubber rolls and to intercept both ends of the cylinder of the seal plate 3. 8 is a pressured gas inlet, and 9 is a drain outlet.

The construction of an example of the present inventive apparatus is as above described. Now the action of this apparatus will be described.

As described above, the apparatus in this example comprises two pairs of rubber rolls with the rolls in each pair respectively pressed against each other, a cylindrical seal plate which is positioned between the two pairs of the rubber rolls in pressure contact with each of the rubber rolls and provided with a pair of oppositely disposed slits extending in the axial direction of each of the contact surfaces of the pairs of the rubber rolls, and an end plane seal plate blocking the both end openings of the seal plate and contacting with the end plane of each of the rubber seal rolls. Therefore, the interior of the cylindrical seal plate forms a closed chamber (a) intercepting the exterior thereof. In supplying high pressure air from the pressured air inlet 8 into this closed chamber (a), the interior of the chamber is kept at a high pressure. Therefore, in transporting a cloth to be dehydrated through the closed chamber (a) via the contact parts of both pairs of the rubber rolls, the cloth can be dehydrated very effectively due to the action of the high pressure air in the closed chamber (a).

In keeping the interior of the closed chamber (a) at reduced pressure by the use of a vacuum pump, a cloth can also be dehydrated effectively. The cylindrical seal plate 3 may be substituted with a square type seal plate 3' with a pair of slits 4' for giving the same result.

As explained above, the present invention comprises two pairs of rubber rolls respectively pressed against each other, a cylindrical seal plate which is positioned between the two pairs of the rubber rolls in pressure contact with each other of the rubber rolls and provided with a pair of oppositely disposed slits open to each of the contact surfaces of the pairs of the rubber rolls, and an end plane seal plate blocking both end openings of the said seal plate and contacting the end plane of each of the rubber rolls so as to form a closed chamber intercepting the interior of the cylindrical seal plate from the exterior thereof. Therefore, in keeping the interior of the closed chamber as a high or reduced pressure chamber, the dehydration of a cloth can be done quite effectively by transporting the cloth continuously through the closed chamber. The construction of the apparatus is very simple, and the present invention can solve the drawbacks in the conventional apparatuses.

What is claimed is:

1. An apparatus for continuous dehydration of a cloth comprising two pairs of axially extending rubber rolls with the axes thereof arranged in parallel relation, the rolls in each said pair being pressed against one another and said pairs of rolls being spaced apart, an axially extending tubular seal plate with the axis thereof in parallel relation with the axes of said pairs of rolls and said seal plate is positioned between said two pairs of rubber rolls with the surface of said seal plate disposed in pressure contact with each of the rubber rolls of said pairs, said seal plate is provided with a pair of oppositely disposed slits extending in the axial direction of said seal plate and aligned with the contact surfaces of said pairs of rubber rolls, and an end plane seal plate blocking each of the end planes of each of said rubber rolls so as to form in combination with said rubber rolls a closed chamber containing and enclosing said tubular seal plate from the exterior of said rubber rolls, and means for maintaining one of high pressure and reduced pressure within said tubular seal plate so that cloth passed in turn between the contacting surfaces of one of said pairs of rolls, through the slits in said seal plate and then between the contacting surfaces of the other said pair of rolls can be dehydrated.

2. An apparatus for continuous dehydration of a cloth, as set forth in claim 1, wherein said tubular seal plate is cylindrically shaped.

3. An apparatus for continuous dehydration of a cloth, as set forth in claim 1, wherein said tubular seal plate has a square cross-section transverse of the axis thereof.

* * * * *